US008245817B2

(12) United States Patent
Casebolt

(10) Patent No.: US 8,245,817 B2
(45) Date of Patent: Aug. 21, 2012

(54) SELF-RESCUE SAFETY DEVICE

(75) Inventor: Scott C. Casebolt, St. Paul Park, MN (US)

(73) Assignee: D B Industries, Inc., Red Wing, MN (US)

( * ) Notice: Subject to any disclaimer, the term of this patent is extended or adjusted under 35 U.S.C. 154(b) by 485 days.

(21) Appl. No.: 12/511,505

(22) Filed: Jul. 29, 2009

(65) Prior Publication Data

US 2010/0025157 A1 Feb. 4, 2010

Related U.S. Application Data

(60) Provisional application No. 61/085,965, filed on Aug. 4, 2008, provisional application No. 61/173,388, filed on Apr. 28, 2009.

(51) Int. Cl.
*A62B 35/00* (2006.01)

(52) U.S. Cl. ..... 182/231; 182/3; 182/5; 182/70; 182/73; 182/75; 182/234; 182/236; 182/239

(58) Field of Classification Search ..... 182/3, 5, 182/70, 73, 75, 231, 234, 236, 239
See application file for complete search history.

(56) References Cited

U.S. PATENT DOCUMENTS

| | | | |
|---|---|---|---|
| 141,378 | A | 7/1873 | Pelham |
| 286,306 | A | 10/1883 | Johnson |
| 301,657 | A | 7/1884 | Arnold |
| 530,863 | A | 12/1894 | Thackston |
| 614,855 | A | 11/1898 | Franklin |
| 624,432 | A | 5/1899 | Buddenbohn et al. |
| 787,394 | A | 4/1905 | Peters |
| 790,001 | A | 5/1905 | Perry |
| 1,016,299 | A | 2/1912 | Snyder |
| 1,020,065 | A | 3/1912 | Welsh |
| 2,761,650 | A | 9/1956 | Faugier |
| 3,946,989 | A | 3/1976 | Tsuda |
| 4,018,423 | A | 4/1977 | Belew |
| 4,125,142 | A | 11/1978 | Föhl |
| 4,253,643 | A | 3/1981 | Forester et al. |
| 4,437,546 | A | 3/1984 | Marinoff et al. |
| 4,448,284 | A | 5/1984 | Ciabo |
| 4,452,430 | A | 6/1984 | Kankkunen |
| 4,457,400 | A | 7/1984 | Donaldson et al. |

(Continued)

FOREIGN PATENT DOCUMENTS

DE 198 18 688 4/1998

(Continued)

OTHER PUBLICATIONS

Bowhunting.Net, "Columns-Monthly: Treestand Safety," http://www.bowhunting.net/artman/publish/Treestand_Safety/New_Rescue_One_CDS_Major_Improvement_in_Treestand_Safety.shtml Mar. 5, 2009.

(Continued)

*Primary Examiner* — Alvin Chin Shue
*Assistant Examiner* — Colleen M Chavchavadze
(74) *Attorney, Agent, or Firm* — IPLM Group, P.A.

(57) ABSTRACT

A self-rescue device includes a rope operatively connected to a lifeline connector. The lifeline connector is releasably operatively connected to a frame member of the self-rescue device, and should a fall occur, the user releases the lifeline connector from the frame member. A centrifugal braking mechanism controls the rate at which the rope is paid out, which controls the rate of the user's descent.

15 Claims, 9 Drawing Sheets

U.S. PATENT DOCUMENTS

| | | | | |
|---|---|---|---|---|
| 4,463,830 | A | | 8/1984 | Geurtsen |
| 4,469,196 | A | | 9/1984 | Sadler |
| 4,480,716 | A | | 11/1984 | Soubry et al. |
| 4,487,292 | A | | 12/1984 | Smith et al. |
| 4,493,396 | A | | 1/1985 | Borgia |
| 4,494,629 | A | | 1/1985 | Raeburn |
| 4,523,664 | A | | 6/1985 | Soubry et al. |
| 4,554,997 | A | | 11/1985 | Sheu |
| 4,567,963 | A | | 2/1986 | Sugimoto |
| 4,588,046 | A | | 5/1986 | van der Neer et al. |
| 4,602,699 | A | | 7/1986 | Matt |
| 4,616,735 | A | | 10/1986 | Orgeron |
| 4,623,038 | A | | 11/1986 | Stancato |
| 4,671,384 | A | | 6/1987 | Sing |
| 4,722,422 | A | | 2/1988 | Hiraoka |
| 4,737,065 | A | | 4/1988 | Ju |
| 4,877,110 | A | | 10/1989 | Wolner |
| 4,938,435 | A | * | 7/1990 | Varner et al. ..... 244/142 |
| 5,060,758 | A | | 10/1991 | Ishioka |
| 5,076,395 | A | | 12/1991 | Kikuchi |
| 5,083,633 | A | | 1/1992 | Seeger |
| 5,351,906 | A | | 10/1994 | Feathers |
| 5,494,133 | A | | 2/1996 | Green et al. |
| 5,701,972 | A | | 12/1997 | Bloder |
| 5,913,383 | A | | 6/1999 | Tseng |
| 6,073,724 | A | | 6/2000 | Wolner et al. |
| 6,085,368 | A | | 7/2000 | Robert et al. |
| 6,253,874 | B1 | | 7/2001 | Casebolt et al. |
| 6,371,244 | B2 | | 4/2002 | Okamura |
| 6,386,344 | B1 | | 5/2002 | Hershtik |
| 6,550,597 | B2 | | 4/2003 | Taniguchi |
| 6,672,428 | B2 | | 1/2004 | Gelman |
| 6,745,872 | B2 | | 6/2004 | Sato |
| 6,810,997 | B2 | | 11/2004 | Schreiber et al. |
| 6,962,235 | B2 | | 11/2005 | Leon |
| 6,966,407 | B2 | | 11/2005 | Karnes et al. |
| 6,971,476 | B2 | | 12/2005 | Wolner et al. |
| 7,073,627 | B2 | | 7/2006 | Casebolt et al. |
| 7,117,975 | B2 | | 10/2006 | Matoba |
| 7,178,632 | B2 | | 2/2007 | Casebolt et al. |
| 7,237,651 | B2 | | 7/2007 | Avots et al. |
| 7,278,601 | B2 | | 10/2007 | Xiaolin |
| 2002/0179372 | A1 | | 12/2002 | Schreiber et al. |
| 2003/0094331 | A1 | | 5/2003 | Vivanco Abarca |
| 2005/0039979 | A1 | | 2/2005 | Gorman et al. |
| 2005/0189177 | A1 | | 9/2005 | Byrne |
| 2006/0113147 | A1 | | 6/2006 | Harris, Jr. |
| 2007/0175698 | A1 | | 8/2007 | Ketring |
| 2007/0261921 | A1 | | 11/2007 | Gal et al. |
| 2008/0128221 | A1 | | 6/2008 | Rogge |

FOREIGN PATENT DOCUMENTS

| | | | |
|---|---|---|---|
| DE | 20 2006 020 127 | U1 | 11/2007 |
| DE | 20 2007 013 135 | U1 | 4/2008 |
| WO | WO 2005/110546 | A1 | 11/2005 |
| WO | WO 2006/094486 | A1 | 9/2006 |

OTHER PUBLICATIONS

Mountaineer Sports, "Rescue One CDS," http://www.mountaineer-sports.com/rescueone.php Nov. 24, 2009.

Suco Spidescape descent systems, "Hands-free and pocket-sized self rescue, multiple victim rescue, and fall protection using 7.5 Spidescape™ rope," VRS-75 Hands-Free Vertical Rescue System, 2007.

Suco Spidescape descent systems, "Hands-free vertical rescue system for 7.5mm rope," 2007.

* cited by examiner

FIG. 2
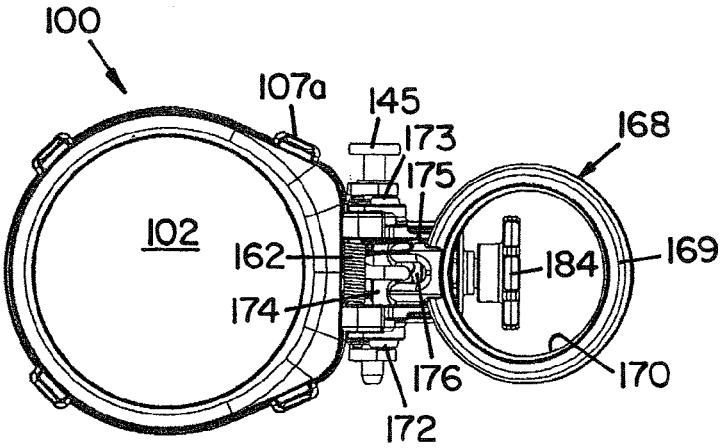
FIG. 3
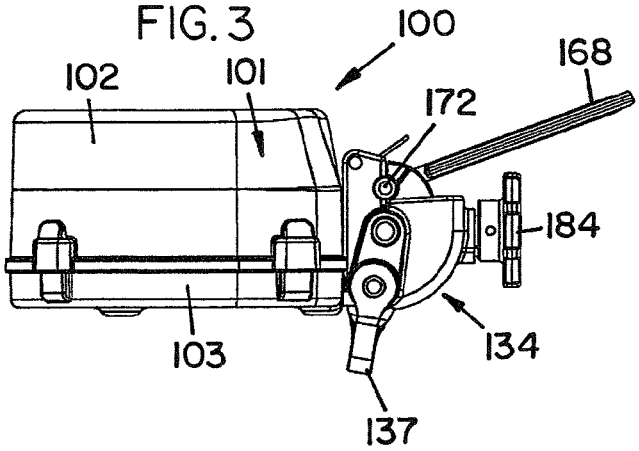
FIG. 5
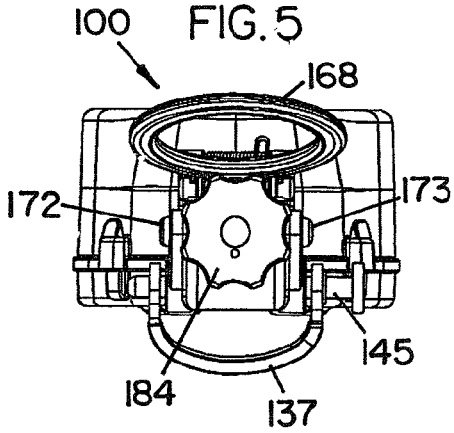
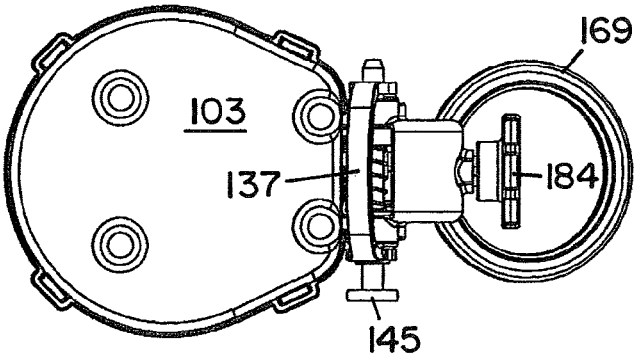
FIG. 4

SELF-RESCUE SAFETY DEVICE

This application claims the benefit of U.S. Provisional Application No. 61/085,965, filed Aug. 4, 2008, and U.S. Provisional Application No. 61/173,388, filed Apr. 28, 2009.

FIELD OF THE INVENTION

The present invention relates to a self-rescue safety device.

BACKGROUND OF THE INVENTION

Various occupations place people in precarious positions at relatively dangerous heights thereby creating a need for fall arrest and fall protection safety apparatus. Among other things, such apparatus usually include a safety line interconnected between a support structure and a person working in proximity to the support structure. The safety line is typically secured to a full-body safety harness worn by the user.

Should a user fall, the user should be rescued as soon as possible to reduce the risk of injuries such as, but not limited to, orthostatic intolerance, also commonly referred to as "suspension trauma".

The present invention addresses the problems associated with the prior art rescue devices and provides for a self-rescue safety device.

SUMMARY OF THE INVENTION

An embodiment self-rescue safety device comprises a frame, a lifeline connector, a rope, a releasable connecting member, and a brake assembly. The frame is configured and arranged to be connected to a safety harness. The rope has an intermediate portion interconnecting a first end and a second end. The first end is operatively connected to the frame, and the second end is operatively connected to the lifeline connector. The releasable connecting member is operatively connected to the frame and the lifeline connector. The releasable connecting member has an engaged position and a disengaged position. The engaged position engages the lifeline connector and the disengaged position allows the lifeline connector to be released from the releasable connecting member. The brake assembly is operatively connected to the frame and controls a rate at which the rope is paid out when the lifeline connector is released.

An embodiment self-rescue safety assembly comprises a safety harness, a housing, a drum, a rope, a sheave, a brake assembly, a releasable connecting member, and a harness connector. The safety harness includes straps and a dorsal pad through which the straps are routed. The housing defines a cavity, and the drum is positioned within the cavity and is rotatably operatively connected to the housing. The rope has an intermediate portion interconnecting a first end and a second end. The first end is operatively connected to the drum, and the second end is operatively connected to the lifeline connector. At least a portion of the intermediate portion is paid out from and wound about the drum as the drum rotates. The sheave, through which a portion of the intermediate portion is routed, is rotatably operatively connected to the drum. The brake assembly is operatively connected to the sheave, and the brake assembly controls a rate at which the rope is paid out from the drum. The releasable connecting member is operatively connected to the drum and the lifeline connector, and the releasable connecting member has an engaged position and a disengaged position. The engaged position engages the lifeline connector and the disengaged position allows the lifeline connector to be released from the releasable connecting member. The harness connector interconnects the drum and the straps of the safety harness.

An embodiment method of self-rescue comprises connecting a self-rescue device to a safety harness. The self-rescue device comprises a frame, a lifeline connector, a rope, a releasable connecting member, and a brake assembly. The frame is configured and arranged to be connected to a safety harness. The rope has an intermediate portion interconnecting a first end and a second end. The first end is operatively connected to the frame, and the second end is operatively connected to the lifeline connector. The releasable connecting member is operatively connected to the frame and the lifeline connector. The releasable connecting member has an engaged position and a disengaged position. The engaged position engages the lifeline connector and the disengaged position allows the lifeline connector to be released from the releasable connecting member. The brake assembly is operatively connected to the frame and controls a rate at which the rope is paid out when the lifeline connector is released. The lifeline connector is released by moving the releasable connecting member from the engaged position to the disengaged position thereby allowing the rope to pay out at a controlled rate.

BRIEF DESCRIPTION OF THE DRAWINGS

FIG. 2 is a front view of the self-rescue device shown in FIG. 1;

FIG. 3 is a side view of the self-rescue device shown in FIG. 1;

FIG. 4 is a rear view of the self-rescue device shown in FIG. 1;

FIG. 5 is a top view of the self-rescue device shown in FIG. 1;

DETAILED DESCRIPTION OF A PREFERRED EMBODIMENT

Figure 1:
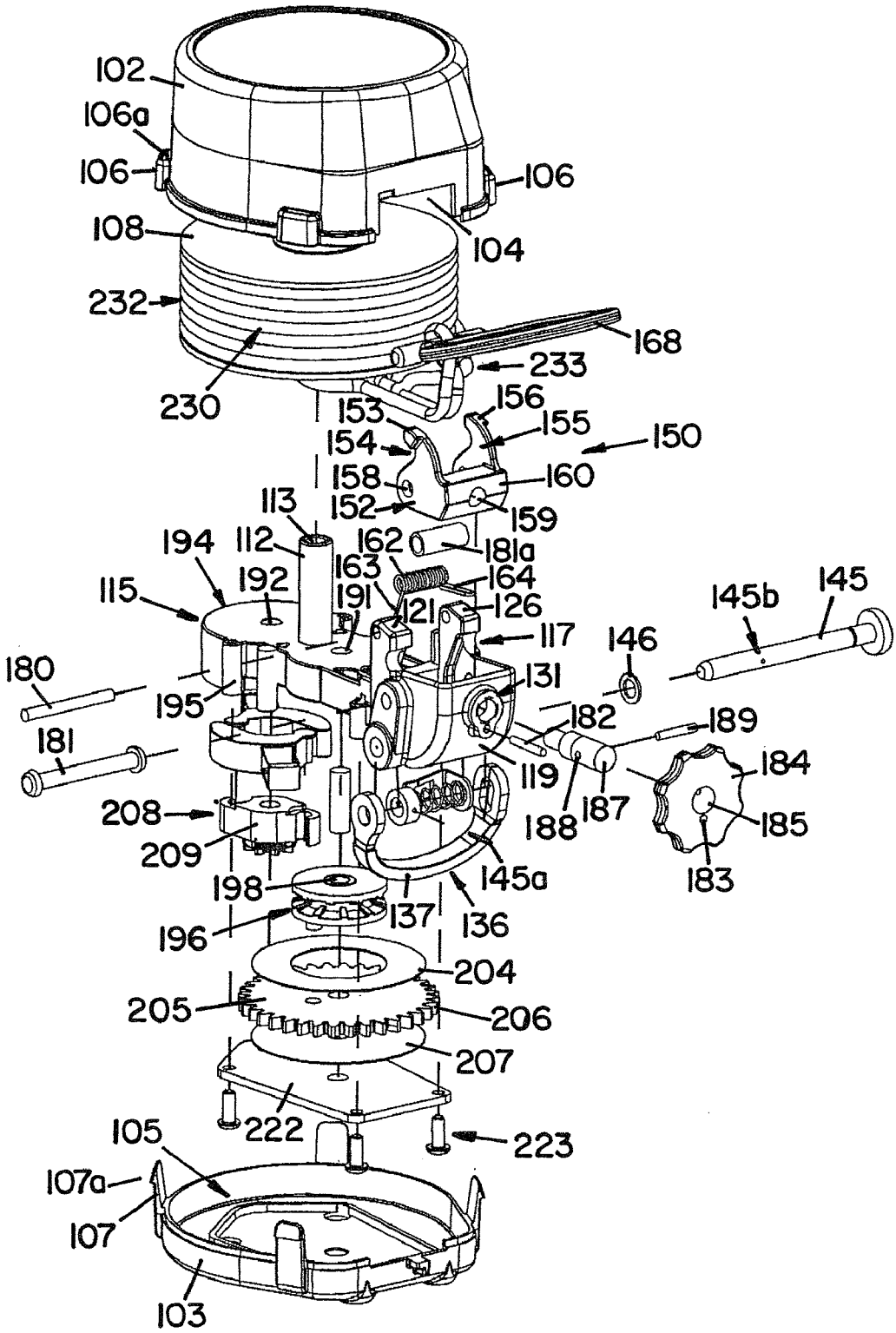
FIG. 1 is an exploded perspective view of a self-rescue device constructed according to the principles of the present invention.
Figure 6:
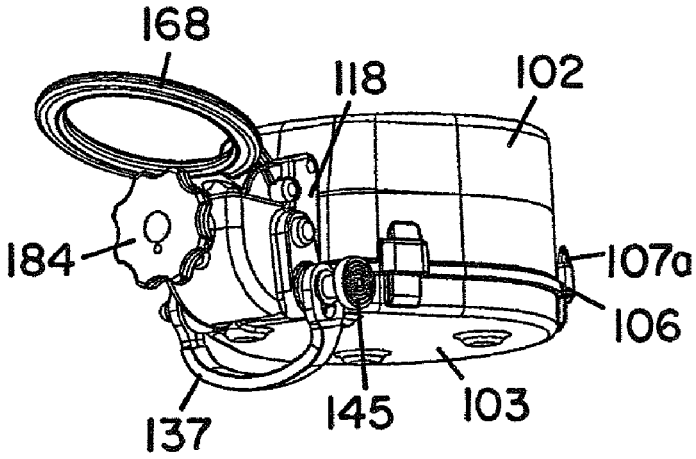
FIG. 6 is a top perspective view of the self-rescue device shown in FIG. 1.

An embodiment self-rescue device constructed according to the principles of the present invention is designated by the numeral 100 in the drawings.

Figure 14:
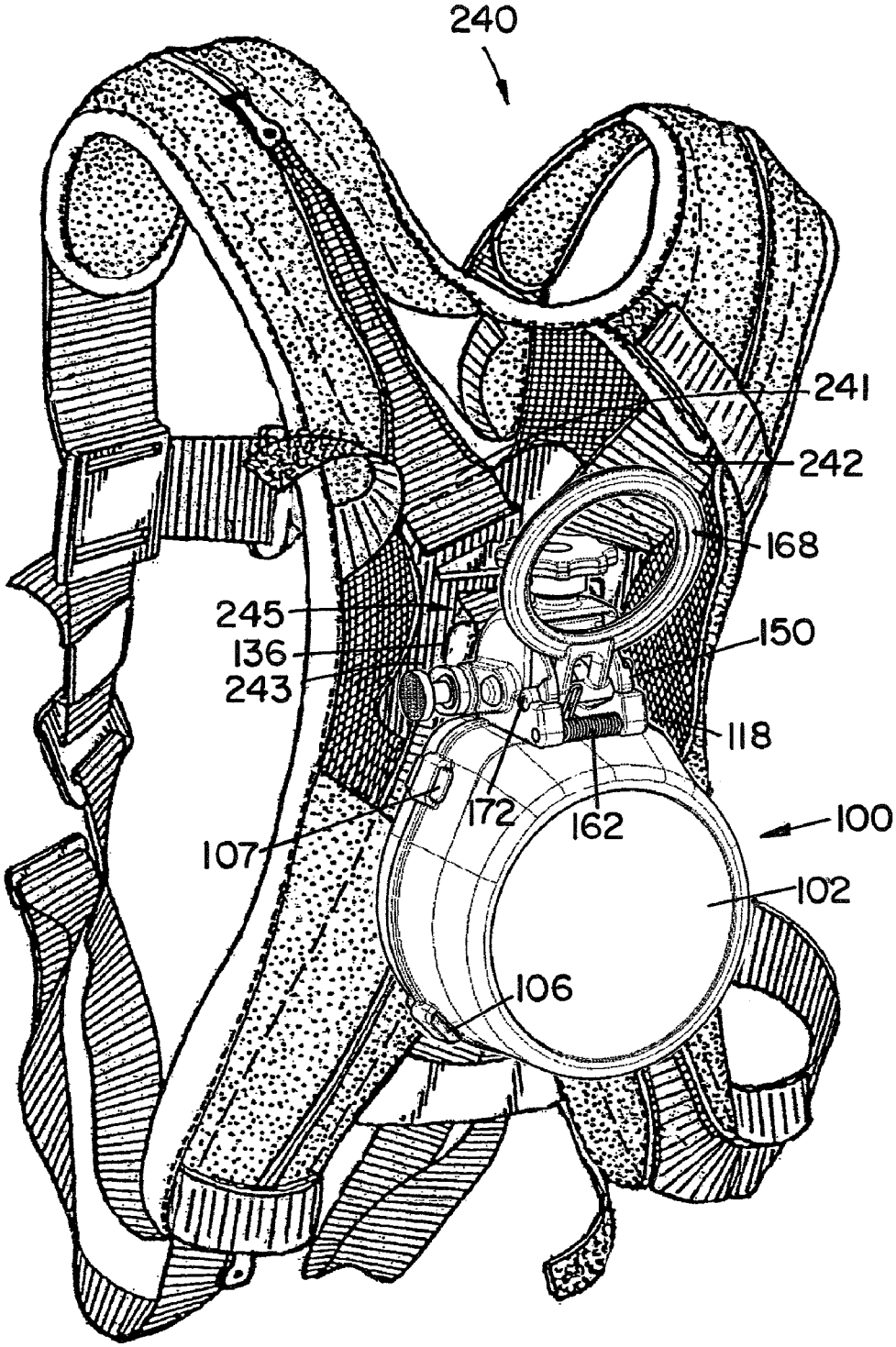
FIG. 14 is a front perspective view of another embodiment self-rescue device constructed according to the principles of the present invention operatively connected to a safety harness.

The self-rescue device 100 includes a housing 101 with a first portion 102 and a second portion 103 which cooperate to form a cavity 105 therebetween and include an opening 104 proximate the top providing access to the cavity 105. The self-rescue device 100 will be described in the orientation as shown in FIG. 14, with the first portion 102 being the front and the second portion being the rear, but this description does not limit the orientation of the device 100. The first portion 102 is preferably oriented proximate the front and includes receivers 106 with apertures 106*a*. The second portion 103 is preferably oriented proximate the rear (proximate the user) and includes extensions 107 with protrusions 107*a* extending outward thereform. When the portions 102 and 103 are connected, the extensions 107 extend outward and through the corresponding apertures 106*a* of the first portion 102. The extensions 107 deflect inward as the protrusions 107*a* slide through the receivers 106 and then deflect outward so that the protrusions 107*a* extend outward and prevent the extensions 107 from sliding out of the receivers 106 to connect the first and second portions 102 and 103. To open the housing 101, the protrusions 107*a* are pushed inward, deflecting the extensions 107 inward to clear the receivers 106, and the protrusions 107*a* and the extensions 107 are slide out of the receivers' apertures 106*a*. Preferably, the device 100 is not intended to be reusable or repairable and, therefore, the housing 101 is not intended to be opened.

The housing 101 is configured and arranged to contain several components of the device. A drum 108 about which a rope 230 is at least partially wound is positioned proximate the first portion 102. A shaft 112 including a bore 113 extends through the drum 108 to assist in rotation of the drum 108 about the shaft 112. Preferably, the shaft 112 is integral with a frame 115 contained within the housing 101 proximate the drum 108.

The rope 230 has a first end (not shown) operatively connected to the drum 108 by means well known in the art, an intermediate portion 232 at least partially wound about the drum 108, and a second end 233 operatively connected to a D-ring 168 or any other suitable connector. The rope could be a synthetic rope, a wire cable, a webbing, or any other suitable type of elongate member. The D-ring 168 includes a ring portion 169 with an aperture 170, a bar portion 171 with a middle portion 174 interconnecting a first end 172 and a second end 173 extending outward therefrom, and a connecting portion 175 interconnecting the ring portion 169 and the middle portion 174 of the bar portion 171. The connecting portion 175 includes an aperture 176 between the ring portion 169 and the bar portion 171. The second end 233 of the rope 230 is inserted through the aperture 176 in the connecting portion 175 and then secured to itself by stitching or other suitable means well known in the art. Preferably, the rope 230 is approximately 30 feet in length.

Figure 11:
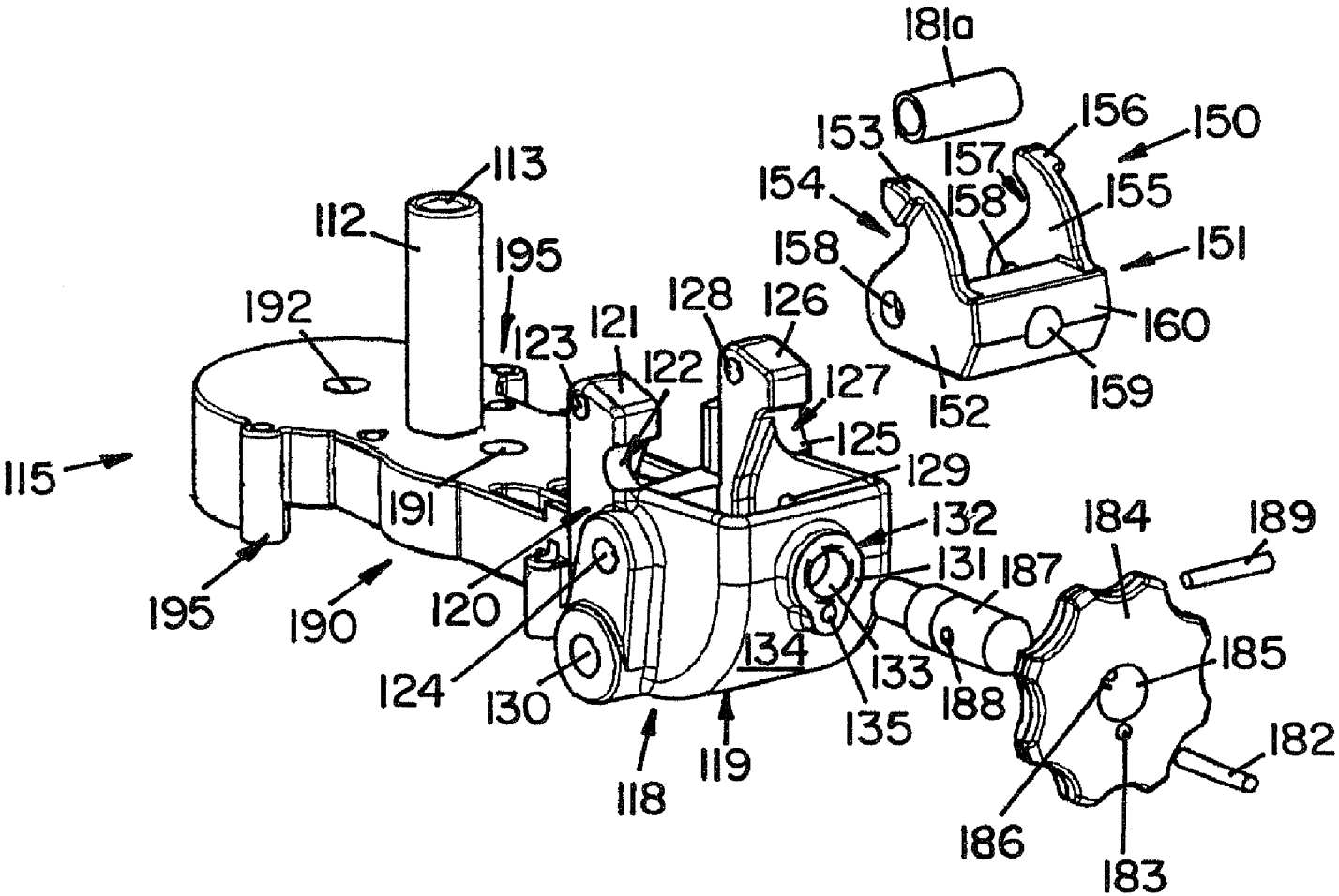
FIG. 11 is an exploded perspective view of a D-ring mounting portion and a D-ring holder of the self-rescue device shown in FIG. 1.
Figure 12:
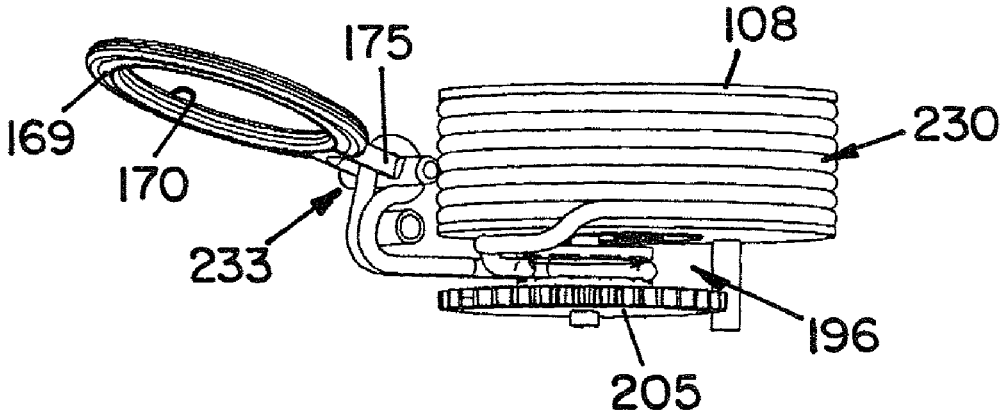
FIG. 12 is a perspective view showing the components of the self-rescue device shown in FIG. 1 to which the rope is operatively connected.
Figure 13:
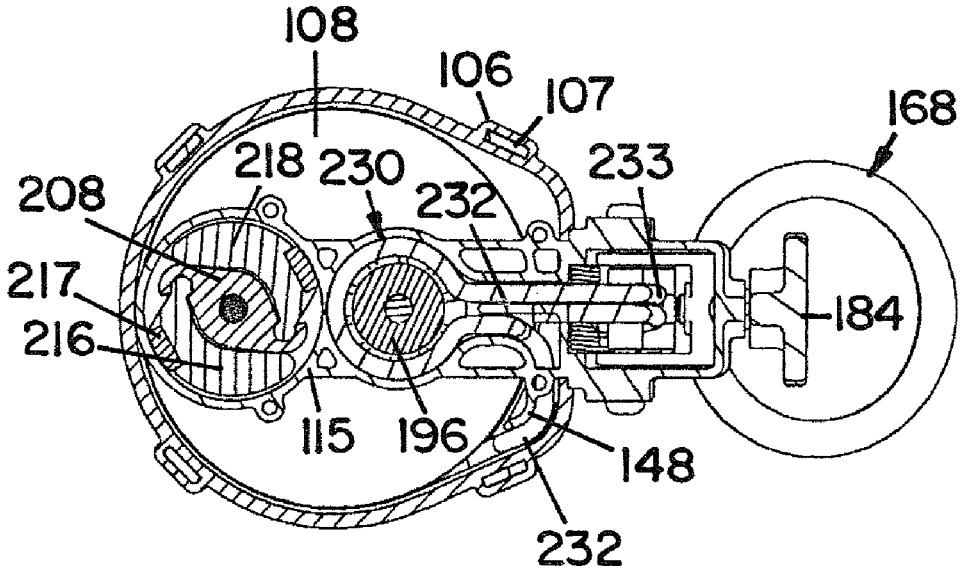
FIG. 13 is a cross-section view of the self-rescue device shown in FIG. 1 showing the rope routed through the device.

The frame 115 is positioned proximate the drum 108 and includes a first end 117, a second end 194, and a middle portion 190. The frame 115 is shown in FIG. 11. The first end 117 includes a D-ring mounting portion 118 with a base 119 having a first side 120, a second side 125, and a top 134. The first side 120 includes a first arm 121 extending outward proximate the bottom of the base 119 having an aperture 123 proximate the distal end and defining a first notch 122 proximate between the aperture 123 and the top 134. The base 119 includes an aperture 124 proximate the middle of the first side 120 and the first arm 121. The second side 125 is on the side of the base 119 opposite the first side 120. The second side 125 includes a second arm 126 extending outward proximate the bottom of the base 119 having an aperture 128 proximate the distal end and defining a second notch 127 proximate between the aperture 128 and the top 134. The base 119 includes an aperture 129 proximate the middle of the second side 125 and the second arm 126. A lateral bore 130 extends through the first side 120 and the second side 125 proximate the rear of the base 119. The top 134, which interconnects the first side 120 and the second side 125, includes an extension portion 131 extending outward proximate the middle of the top 134. The extension portion 131 includes a longitudinal bore 133 extending through the extension portion 131 proximate its center and a relatively smaller bore 135 extending through the extension portion 131 proximate the longitudinal bore 133. The top 134, the first side 120, and the second side 125 define a cavity therebetween.

A D-ring holder 150 includes a base 151 having a first side 152, a second side 155, and a top 160. The first side 152 includes a first arm 153 extending outward proximate the front of the base 151 and defines a first notch 154 proximate between the distal end of the first arm 153 and the base 151. The second side 155 is on the side of the base 151 opposite the first side 152. The second side 155 includes a second arm 156 extending outward proximate the front of the base 151 and defines a second notch 157 proximate between the distal end of the second arm 156 and the base 151. The base 151 includes a lateral bore 158 extending through the sides 152 and 155 proximate below the notches 154 and 157. The base 151 also includes a longitudinal bore 159 extending through the base 151 proximate the middle of the top 160.

The arms 121 and 126 of the D-ring mounting portion 118 are proximate the bottom of the base 119, and the notches 122 and 127 are proximate the inner, front sides of the arms 121 and 126. The arms 153 and 156 of the D-ring holder 150 are proximate the front of the base 151, and the notches 154 and 157 are proximate the inner, bottom sides of the arms 153 and 156. When the D-ring holder 150 is connected to the D-ring mounting portion 118, the notches 122 and 154 form an opening through which the first end 172 of the D-ring 168 extends and the notches 127 and 157 form an opening through which the second end 173 of the D-ring 168 extends. Thus, the D-ring 168 is positioned within the notches and held in place between the arms.

To connect the D-ring holder 150 to the D-ring mounting portion 118, the D-ring holder 150 is positioned within the cavity formed by the top 134 and the sides 120 and 125 so that the top 160 is proximate the top 134. The D-ring holder 150 and the D-ring mounting portion 118 are best shown in FIG. 11. The apertures 124 and 129 in the sides 120 and 125 of the D-ring mounting portion 118 are aligned with the lateral bore 158 of the D-ring holder 150, and a fastener 181 is inserted through the apertures 124 and 129 in the sides 120 and 125 and the bore 158 to connect the D-ring mounting portion 118 and the D-ring holder 150. The fastener 181 extends through a cylindrical portion 181 a, which is preferably a nylon tube, positioned between the apertures 124 and 129. A torsion spring 162 includes a first end 163 and a second end 164, and between the ends 163 and 164 the spring 162 is wound to define a bore, which is aligned with the apertures 123 and 128 in the arms 121 and 126. A pin 180 is inserted through the apertures 123 and 128 and the spring's bore. The first end 163 of the spring 162 is positioned so that it exerts pressure on the frame 115, and the second end 164 of the spring 162 exerts pressure on the D-ring 168 when assembled. The D-ring 168 is pivotable within the notches, and the D-ring 168 is biased in an upward direction by the spring 162.

A harness connector 136 includes a bar portion 137 with a first end 138 having a first aperture 139 and a second end 140 having a second aperture 141, which is preferably a slot. Preferably, the bar portion 137 is generally U-shaped. A spring 142 has a locking ring 143 operatively connected to one end and a locking lever 144 operatively connected to the opposite end. The locking ring 143 and the locking lever 144 have bores slightly larger than the outside diameter of the pin 145. The lateral bores 130 and 158 in the base are also slightly larger than the outside diameter of the pin 145. The locking ring 143 is secured to the pin 145 with a spring pin 145*a* through the bore 145*b*, and the locking ring 143 is located proximate the inside surface of the first side 120 of the base 119. The locking lever 144 is positioned proximate the inside surface of the second side 125 of the base so that the spring 142 biases the pin 145 toward the first side 120. The pin 145 extends through a washer 146, through the aperture 141, through the bore 130, and through the aperture 139. The harness connector could be similar to the connector disclosed in U.S. Pat. No. 6,073,724, which is incorporated by reference herein.

A knob 184 includes a cylindrical portion (not shown) extending outward from the knob 184 and a bore 185 extending longitudinally through the center of the knob 184 and the cylindrical portion. A relatively smaller bore 183 extends longitudinally through the knob 184 proximate the bore 185. The bore 183 corresponds with the bore 135 of the extension portion 131 when assembled, and a pin 182 extends through the bores 183 and 135 to connect the knob 184 to the base 119 of the D-ring mounting portion 118. A bore 186 extends laterally through the cylindrical portion and the bore 185. A pin 187 is configured and arranged to extend through the bores 185 and 133 and into the longitudinal bore 159 of the D-ring holder 150. The pin 187 includes a bore 188, which corresponds with the bore 186 when the pin 187 is positioned in the bore 185, and a fastener 189 extends through the bores 186 and 188 to connect the pin 187 to the knob 184. The bore 133 and a portion of the pin 187 are threaded so the pin 187 is screwed into the base 119. Once connected, the knob 184 is held in place by the phenolic pin 182, unless the user turns the knob 184 with sufficient force to break the pin 182.

The pin 187 could be connected to the knob 184 as shown or integral with the knob 184. The pin could also be a detent pin to hold the knob in place, or a compression spring could bias the pin in place. In addition, the pin could include a head portion and a shaft portion that could slide within the bore 185 of the knob 184, but the head portion would preferably be larger than the bore 185 and therefore the pin would be removed as the knob 184 is removed from the extension portion 131.

Although the D-ring mounting portion 118, the D-ring holder 150, and the knob 184 are used to connect the D-ring 168 to the device, it is recognized that any other suitable releasable connecting member could be used to connect the D-ring 168 to the device. The releasable connecting member preferably has an engaged position and a disengaged position. The engaged position engages the D-ring 168, and the disengaged position allows the D-ring 168 to be released from the releasable connecting member.

The middle portion 190 of the frame 115 includes a first bore 191 proximate the first end 117 and a second bore 192 proximate the second end 194. The under-side, shown in FIG. 7, of the middle portion 190 includes a recessed area defining a cavity 193. The second end 194 includes protrusions 195, which are intended to better dissipate heat created during descent because they increase the surface area and the volume of the frame 115 proximate the centrifugal brake rotor 208. The under-side, shown in FIG. 7, of the second end 194 includes a recessed area with side surfaces 203 defining a cavity 202.

A sheave 196 is generally cylindrical in shape with a bore 198 and a groove 197 about its rounded sides and is operatively connected to a gear 205 with teeth 206. A shaft 110 extends through the bore 191 of the frame 115 and the bore 198 of the sheave 196 to position the sheave 196 within the cavity 193 of the frame 115. Plastic discs 204 and 207 could be used to reduce friction between the gear 205 and the frame 115 and the plate 222, respectively.

Figure 7:
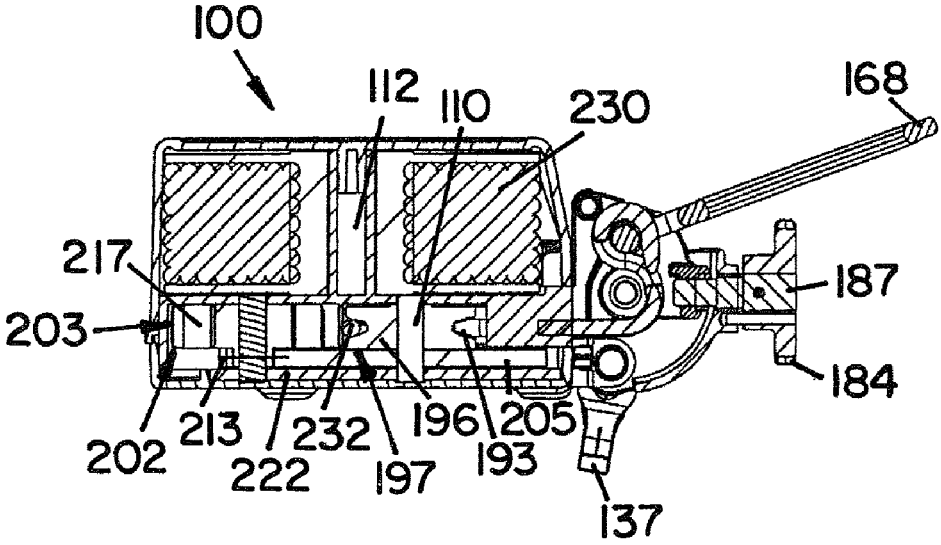
FIG. 7 is a cross-section view of the self-rescue device shown in FIG. 1.
Figure 8:
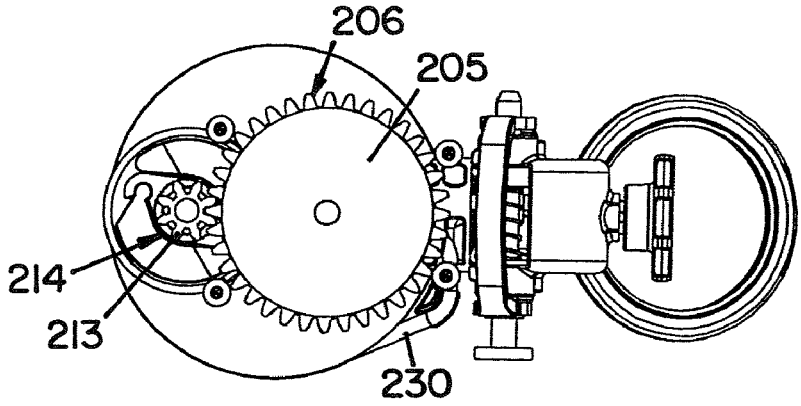
FIG. 8 is a rear view of the self-rescue device shown in FIG. 1 with a portion of the housing and a plate removed to show the gear and the spur gear.
Figure 9:
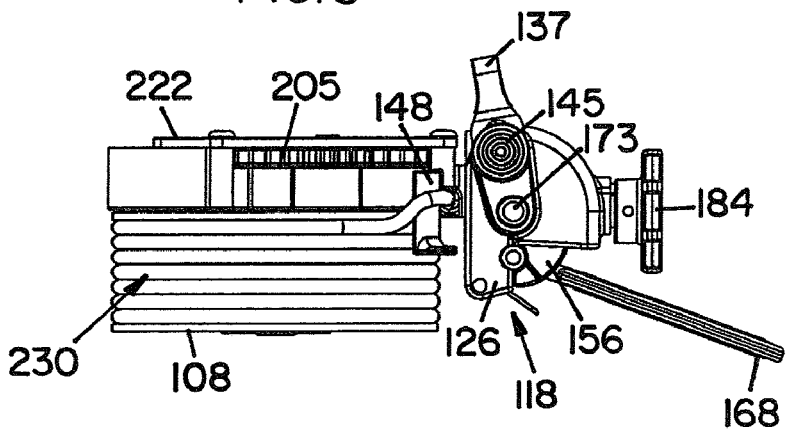
FIG. 9 is a side view of the self-rescue device shown in FIG. 1 with the housing removed.
Figure 10:
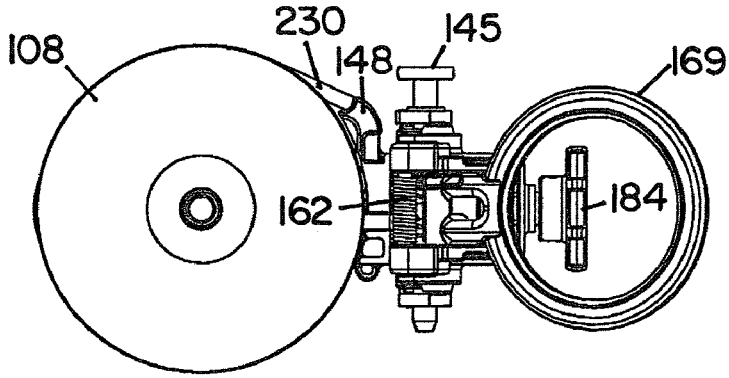
FIG. 10 is a front view of the self-rescue device shown in FIG. 1 with the housing removed.

As shown in FIG. 7, the sheave 196 fits within the cavity 193 of the middle portion 190. The rope 230 is looped around a curved feature 148 on the drum 108 as it enters the frame 115 proximate the sheave 196 to reduce the likelihood of the rope 230 getting caught and preventing the rope 230 from feeding through the device. The curved feature 148 is shown in FIGS. 9 and 10. Rollers could be added proximate the curved feature 148 to reduce friction.

A centrifugal brake rotor 208 includes a base 209, which is preferably cylindrical, through which a bore 210 extends, and a pin 215 extends through the bore 210 and the second bore 192 to position the rotor 208 within the cavity 202 of the frame 115. A first pawl receiver 211 and a second pawl receiver 212 are operatively connected to opposing sides of the base 209. A spur gear 213 is operatively connected to the another side of the base 209 and includes teeth 214, which mate with the teeth 206 of the gear 205. A first pawl 216 to which a first friction pad 217 is operatively connected and a second pawl 218 to which a second friction pad 219 is operatively connected are pivotally connected to the pawl receivers 211 and 212, respectively, and are positioned about the base 209 within the cavity 202. As shown in FIG. 7, the centrifugal brake rotor 208 is held in place between the frame 115 and the plate 222, and fasteners 223 secure the plate 222 to the frame 115.

A safety harness 240 includes a first strap 241 and a second strap 242 routed through a dorsal pad assembly 243, and a D-ring 244 is operatively connected to the straps 241 and 242 between the straps 241 and 242 and the dorsal pad assembly 243 as is well known in the art. It is recognized that any suitable safety harness could be used with the present invention. Although any suitable safety harness could be used, examples of suitable safety harnesses that could be used are disclosed in U.S. Pat. Nos. 6,253,874 and 6,971,476, which are incorporated by reference herein. In addition, the safety harness could include a dorsal pad assembly such as one of those disclosed in U.S. Pat. Nos. 6,253,874; 7,073,627; and 7,178,632; which are incorporated by reference herein.

As shown in FIG. 14, the harness connector 136 is inserted through a space 245 between the dorsal pad assembly 243 and the straps 241 and 242 to connect the self-rescue device 100 to the safety harness 240. Preferably, the D-ring 244 on the safety harness 240 is pivoted downward and out of the way of the self-rescue device 100, and the D-ring 168 of the self-rescue device 100 is used instead.

Figure 15:
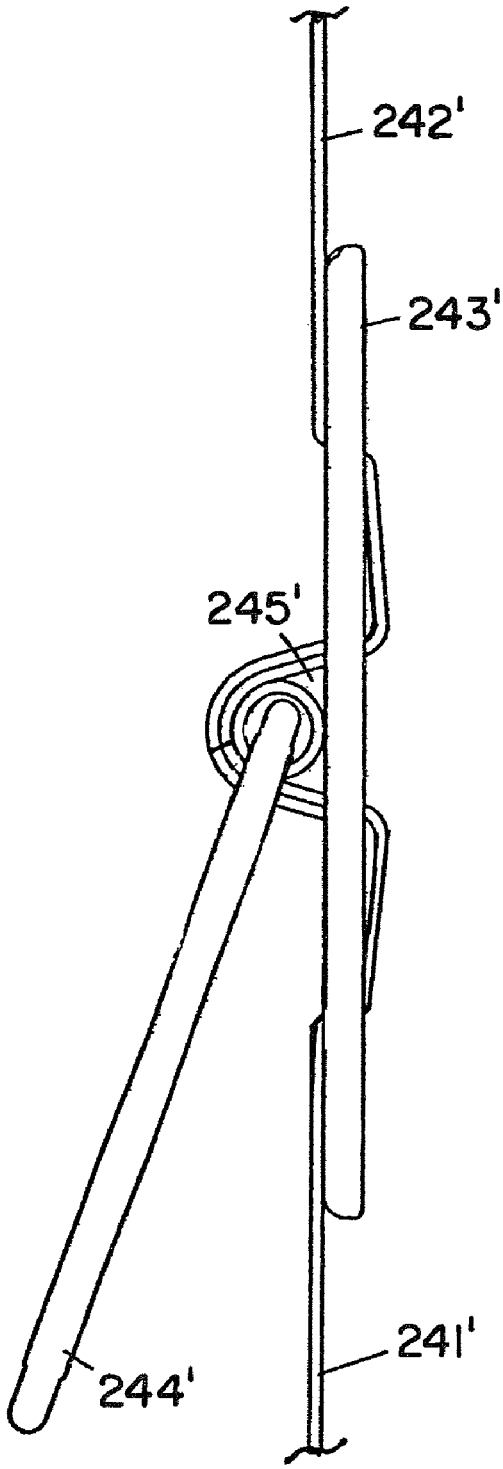
FIG. 15 is a partial side view of a safety harness to which a self-rescue device could be operatively connected.
Figure 16:
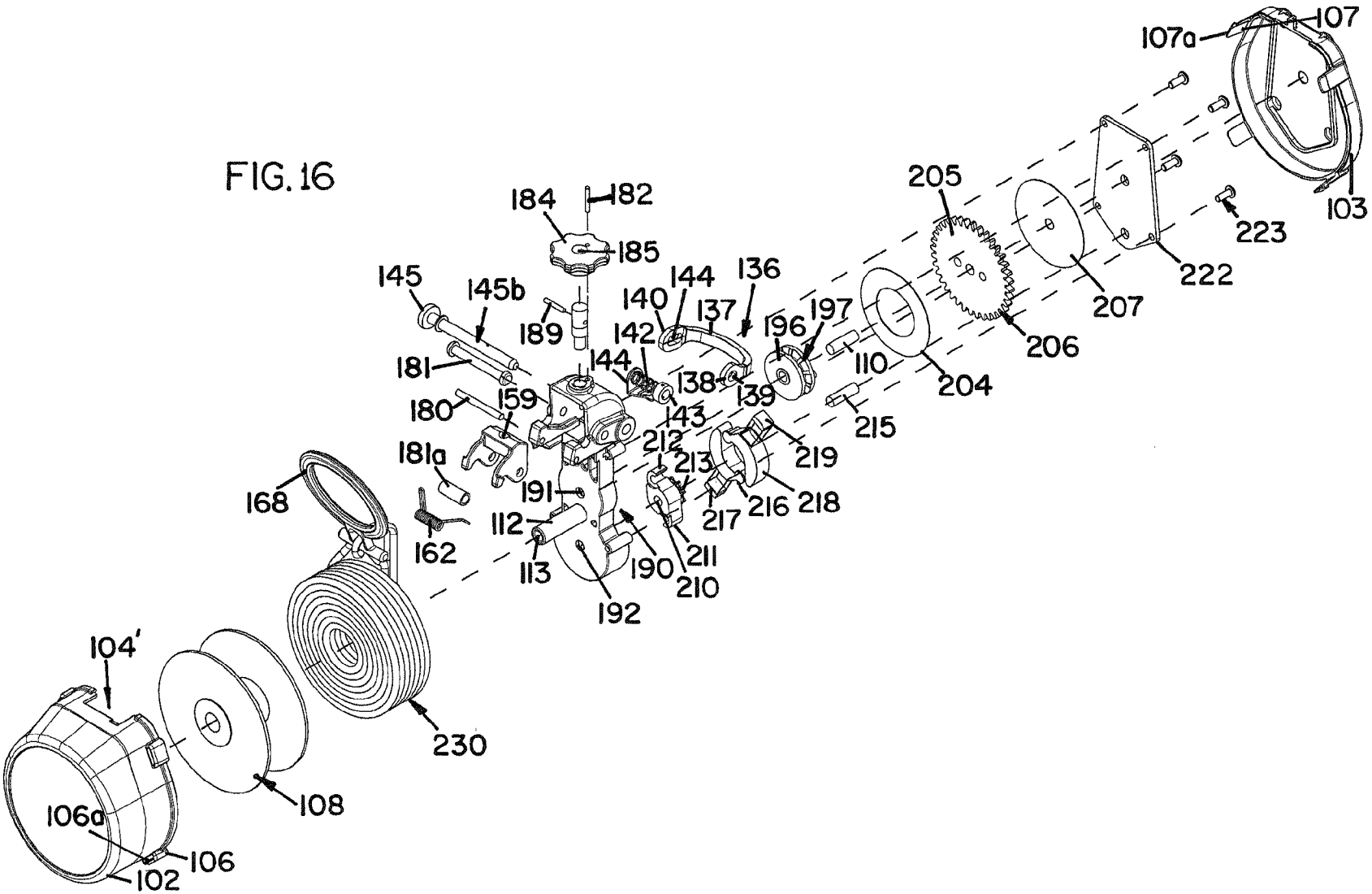
FIG. 16 is an exploded perspective view of the self-rescue device shown in FIG. 1.

A portion of another safety harness is shown in FIG. 15. The harness connector 136 could be inserted through a space 245' between the dorsal pad assembly 243' and the straps 241' and 242' to connect the self-rescue device 100 to the safety harness. Preferably, the D-ring 244' on the safety harness is pivoted downward and out of the way of the self-rescue device 100, and the D-ring 168 of the self-rescue device 100 is used instead.

Once the self-rescue device 100 is connected to a safety harness and the D-ring 168 is operatively connected to a support structure, should a fall occur, the user may use the self-rescue device 100 to lower herself or himself to safety. To activate the device, the user releases the D-ring 168 by turning the knob 184, breaking the pin 182 and unscrewing the pin 187 away from the extension portion 131 and pulling the pin 187 at least out of the bore 159 of the D-ring holder 150 so that the D-ring holder 150 may be pivoted away (upward) from the D-ring 168, which creates a gap or an opening between the arms of the D-ring holder 150 and the D-ring mounting portion 118 so that the ends 172 and 173 of the bar portion 171 can be removed from the notches of the D-ring holder 150 and the D-ring mounting portion 118. Once the D-ring 168 is released, the descending begins. As the rope 230 is paid out from the drum 108, the rope 230 causes the sheave 196 to rotate, which causes the gear 205 to rotate, which causes the spur gear 213 to rotate, which causes the base 209 to rotate. As the base 209 rotates, the pawls 216 and 218 will pivot outward and the friction pads 217 and 219 will contact the surfaces 203 to provide resistance to slow the rate at which the rope 230 is pulled through the device 100 thus controlling the rate of the user's descent. The controlled rate at which the rope is paid out (i.e., the rate of descent) is preferably approximately 1½ to 6 feet per second.

The brake assembly does not include springs so the pawls 216 and 218 could pivot outward during use of the device 100. Thus, it is possible the friction pads 217 and 219 could contact the surfaces 203 but until the base 209 is rotating rapidly, relatively little to no braking force would occur. As the rotational rate increases, the braking force increases. It is recognized that the brake assembly could also include springs to bias the pawls inward relative to the base.

The drum 108 is not spring biased but because the D-ring 168 is held in place by the D-ring holder 150 and the D-ring mounting portion 118, the rope 230 does not get paid out unless the D-ring 168 is released from the D-ring holder 150 and the D-ring mounting portion 118.

The centrifugal braking mechanism automatically allows for controlled descending along at least a majority of the length of the rope 230. To prevent the rope from disconnecting from the device in the event a descent greater than the maximum descent height of the device is attempted, a stop could be included proximate the first end of the rope.

The self-rescue device 100 is preferably relatively small in size. For example, the self-rescue device 100 could have a thickness similar to that of the twin leg, tie-off TALON self-retracting lifeline by D B Industries, Inc., a diameter similar to that of the REBEL or TALON self-retracting lifelines by D B Industries, Inc., and a weight of approximately 3 pounds or less.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A self-rescue safety device, comprising:

a frame configured and arranged to be connected to a safety harness;

a lifeline connector;

a rope having an intermediate portion interconnecting a first end and a second end, the first end being operatively connected to the frame, the second end being operatively connected to the lifeline connector;

a sheave through which a portion of the intermediate portion is routed, the sheave being rotatably operatively connected to the frame;

a releasable connecting member operatively connected to the frame and the lifeline connector, the releasable connecting member having an engaged position and a disengaged position, the engaged position engaging the lifeline connector and the disengaged position allowing the lifeline connector to be released from the releasable connecting member;

a brake assembly operatively connected to the frame, the brake assembly controlling a rate at which the rope is paid out when the lifeline connector is released;

the frame includes a brake cavity configured and arranged to receive at least a portion of the brake assembly, the brake cavity being defined by a frame surface, wherein the brake assembly comprises a rotor to which at least one pawl is pivotally connected and to which a rotor gear is operatively connected and at least one brake pad operatively connected to the at least one pawl, the at least one brake pad contacting the frame surface to control the rate at which the rope is paid out as the sheave rotates; and a sheave gear operatively connected to the sheave, the sheave gear mating with the rotor gear operatively connected to the rotor.

2. The self-rescue safety device of claim 1, further comprising a drum rotatably operatively connected to the frame, the first end of the rope being operatively connected to the drum, the brake assembly being operatively connected to the drum; and wherein at least a portion of the intermediate portion is paid out from and wound about the drum as the drum rotates.

3. The self-rescue safety device of claim 1, further comprising a drum rotatably operatively connected to the frame, the frame interconnecting the drum and the releasable connecting member, wherein the sheave is rotatably operatively connected to the frame.

4. The self-rescue safety device of claim 1, further comprising a biasing member engaged to assert a biasing force between the frame and the lifeline connector.

5. The self-rescue safety device of claim 1, wherein the releasable connecting member comprises a mounting portion and a holder configured and arranged to engage the lifeline connector in the engaged position and to release the lifeline connector in the disengaged position.

6. The self-rescue safety device of claim 5, wherein the mounting portion and the holder are pivotally connected and a knob interconnects the mounting portion and the holder in the engaged position to prevent pivoting, the knob is removable to pivot at least one of the mounting portion and the holder to position the releasable connecting member in the disengaged position.

7. A self-rescue safety assembly, comprising:

a safety harness including straps and a dorsal pad through which the straps are routed;

a housing defining a cavity;

a drum positioned within the cavity and rotatably operatively connected to the housing;

a rope having an intermediate portion interconnecting a first end and a second end, the first end being operatively connected to the drum, the second end being operatively connected to a lifeline connector, and wherein at least a portion of the intermediate portion is paid out from and wound about the drum as the drum rotates;

a sheave through which a portion of the intermediate portion is routed, the sheave being rotatably operatively connected to the drum;

a brake assembly operatively connected to the sheave, the brake assembly controlling a rate at which the rope is paid out from the drum;

a releasable connecting member operatively connected to the drum and the lifeline connector, the releasable connecting member having an engaged position and a disengaged position, the engaged position engaging the lifeline connector and the disengaged position allowing the lifeline connector to be released from the releasable connecting member;

a harness connector interconnecting the drum and the straps of the safety harness;

further comprising a frame operatively connected to the drum, the frame including a brake cavity configured and arranged to receive at least a portion of the brake assembly, the brake cavity being defined by a frame surface, wherein the brake assembly comprises a rotor to which at least one pawl is pivotally connected and to which a rotor gear is operatively connected and at least one brake pad operatively connected to the at least one pawl, the at least one brake pad contacting the frame surface to control the rate at which the rope is paid out from the drum as the sheave rotates; and further comprising a sheave gear operatively connected to the sheave, the sheave gear mating with the rotor gear operatively connected to the rotor.

8. The self-rescue safety assembly of claim 7, further comprising a frame interconnecting the drum and the releasable connecting member.

9. The self-rescue safety assembly of claim 8, wherein the sheave is rotatably operatively connected to the frame.

10. The self-rescue safety assembly of claim 7, further comprising a biasing member biasing the lifeline connector in an upright position.

11. The self-rescue safety assembly of claim 7, wherein the releasable connecting member comprises a mounting portion and a holder configured and arranged to engage the lifeline connector in the engaged position and to release the lifeline connector in the disengaged position.

12. The self-rescue safety assembly of claim 11, wherein the mounting portion and the holder are pivotally connected and a knob interconnects the mounting portion and the holder in the engaged position to prevent pivoting, the knob is removable to pivot at least one of the mounting portion and the holder to position the releasable connecting member in the disengaged position.

13. A method of self-rescue, comprising:

connecting a self-rescue device to a safety harness, the self-rescue device comprising a frame configured and arranged to be connected to a safety harness, a lifeline connector, a rope having an intermediate portion interconnecting a first end and a second end, the first end being operatively connected to the frame, the second end being operatively connected to the lifeline connector, a releasable connecting member operatively connected to the frame and the lifeline connector, the releasable connecting member having an engaged position and a disengaged position, the engaged position engaging the lifeline connector and the disengaged position allowing the lifeline connector to be released from the releasable connecting member, a brake assembly operatively connected to the frame, the brake assembly controlling a rate at which the rope is paid out when the lifeline connector is released;

turning a knob to break a first pin; and removing a second pin operationally coupled to the knob from the releasable connecting member to disengage the lifeline connector thereby allowing the rope to pay out at a controlled rate.

14. The method of claim 13, wherein the controlled rate is approximately 1½ to 6 feet per second.

15. The method of claim 13, wherein removing the second pin from the releasable connecting member further comprises:

unscrewing the second pin away from the releasable connecting member.

* * * * *